US008968530B2

(12) United States Patent
Hotta et al.

(10) Patent No.: US 8,968,530 B2
(45) Date of Patent: Mar. 3, 2015

(54) ELECTROLYTIC TREATMENT METHOD AND ELECTROLYTIC TREATMENT DEVICE

(75) Inventors: Hisashi Hotta, Shizuoka (JP); Tsuyoshi Hirokawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 909 days.

(21) Appl. No.: 13/121,356

(22) PCT Filed: Sep. 30, 2009

(86) PCT No.: PCT/JP2009/067103

§ 371 (c)(1),
(2), (4) Date: Mar. 28, 2011

(87) PCT Pub. No.: WO2010/038812

PCT Pub. Date: Apr. 8, 2010

(65) Prior Publication Data

US 2011/0174635 A1 Jul. 21, 2011

(30) Foreign Application Priority Data

Sep. 30, 2008 (JP) ..... 2008-254373

(51) Int. Cl.
*C25F 3/04* (2006.01)
*B41N 3/03* (2006.01)
(Continued)

(52) U.S. Cl.
CPC . *C25F 3/04* (2013.01); *B41N 3/034* (2013.01); *C25D 5/18* (2013.01); *C25D 7/0607* (2013.01);
(Continued)

(58) Field of Classification Search
CPC ..... C25F 3/04; B41N 3/034
USPC ..... 204/229.4, 275.1; 205/646, 658
See application file for complete search history.

(56) References Cited

U.S. PATENT DOCUMENTS 5,358,610 A 10/1994 Kawasumi et al.
5,667,666 A * 9/1997 Matsuura et al. ..... 205/640
2006/0201819 A1 9/2006 Matsuura et al.

FOREIGN PATENT DOCUMENTS

JP 6-88299 A 3/1994
JP 2002-363799 A 12/2002
JP 2004-243633 A 9/2004

OTHER PUBLICATIONS

Chinese Office Action issued in Chinese Application No. 200980138273.X on Mar. 31, 2014.
(Continued)

*Primary Examiner* — Nicholas A Smith
(74) *Attorney, Agent, or Firm* — Birch, Stewart, Kolasch & Birch, LLP

(57) ABSTRACT

An electrolytic treatment method and electrolytic treatment device are provided for electrolytic treatment of an aluminum web W by applying an alternating current to an upstream electrode and a downstream electrode disposed along a conveying direction a. At least one of a conveying velocity v of the aluminum web W, a frequency f of alternating current applied at the upstream electrode and the downstream electrode, and/or a web conveying direction separation distance d2 between the upstream electrode and the downstream electrode are set such that the alternating current and voltage waveform applied to the aluminum web W at the far end of the upstream electrode and the alternating current and voltage waveform applied to the aluminum web W at the near end of the downstream electrode do not reinforce each other.

8 Claims, 3 Drawing Sheets

(51) Int. Cl.

| | |
|---|---|
| ***C25D 5/18*** | (2006.01) |
| ***C25D 7/06*** | (2006.01) |
| ***C25D 11/04*** | (2006.01) |
| ***C25D 11/02*** | (2006.01) |
| ***C25D 11/00*** | (2006.01) |
| ***C25F 7/00*** | (2006.01) |
| *C25D 11/18* | (2006.01) |

(52) U.S. Cl.

CPC ..... *C25D 7/0635* (2013.01); *C25D 11/04* (2013.01); *C25D 11/024* (2013.01); *C25D 11/005* (2013.01); *C25F 7/00* (2013.01); *C25D 11/18* (2013.01)

USPC ..... 204/229.4; 204/275.1; 205/646; 205/658

(56) References Cited

OTHER PUBLICATIONS

Supplementary European Search Report issued in European Application No. 09817844.5 on Jul. 16, 2014.

* cited by examiner

ELECTROLYTIC TREATMENT METHOD AND ELECTROLYTIC TREATMENT DEVICE

TECHNICAL FIELD

The present invention relates to an electrolytic treatment method and electrolytic treatment device, and in particular to an electrolytic treatment method and electrolytic treatment device that can efficiently suppress chatter marks from occurring in alternating current electrolytic treatment of a web.

BACKGROUND ART

Electrolytic surface roughening treatment is widely executed by alternating current electrolytic treatment in surface roughening processes for a planographic printing plate support, in which surface roughening is performed to one or both faces of an aluminum web made from pure aluminum or aluminum alloy.

However, in electrolytic surface roughening treatment, there is an issue with chatter marks, these being stripe shaped patterns along the width direction of the aluminum web, sometimes occurring to the face of the aluminum web for surface roughening.

As a method for preventing the occurrence of chatter marks, there is a proposal to set x, y and f to satisfy the following when performing electrolytic surface roughening treatment, wherein the conveying velocity of the aluminum web is y (m/minute), the power supply frequency is f (Hz), and the separation distance between the leading end portions of two adjacent electrodes is x (cm):

$$0g(60\times f/100y)\leq 0.2, \text{ or}$$

$$0.8\leq g(60\times f/100y)<1 \qquad \text{Equation (1)}$$

$$g(a)=a-[a], \text{ wherein } [a] \text{ is the maximum integer not exceeding } a \qquad \text{Equation (2)}$$

(see Japanese Patent Application Laid-Open (JP-A) No. 6-88299).

Furthermore, in similar electrolytic surface roughening treatment, if the movement velocity of the aluminum web is V (m/minute) and the current density at peaks in the alternating current is D (A/dm$^2$), there is a proposal to set V and D so as to satisfy $$70\leq V\leq 160,\ 20\leq D\leq 200,\ D\leq 122000V^{-1.55}$$

(see JP-A No. 2004-243633).

DISCLOSURE OF INVENTION

Technical Problem

However, even when the conveying velocity of the web, the frequency of power supply, the separation distance between the leading end portions of the two adjacent electrodes, and the current density at during peaks in the alternating current are set according to the equations described in the above publications, chatter marks on the aluminum web cannot be completely prevented from occurring.

The present invention is made to address these issues, and an object thereof is to provided an electrolytic treatment method and electrolytic treatment device capable of efficiently suppressing chatter marks from occurring when performing electrolytic surface roughening treatment to an aluminum web.

Solution to Problem

A first aspect of the present invention is an electrolytic treatment method of electrolytic treatment by conveying a web at a specific conveying velocity along a specific direction and applying an alternating current to plural electrodes disposed along the conveying direction of the web. The electrolytic treatment method includes setting the web conveying velocity, frequencies of alternating current applied to a first electrode and another electrode and web conveying direction separation distance between the first electrode and the other electrode such that the alternating current and voltage waveform applied to the web when a point on the web passes the far end of the first electrode and the alternating current and voltage waveform applied to the web when the point passes the near end of the other electrode adjacent on the downstream side of the first electrode do not reinforce each other.

A second aspect of the present invention is the electrolytic treatment method according to the first aspect, wherein the web is a web of either pure aluminum or an aluminum alloy.

A third aspect of the present invention is the electrolytic treatment method according to the first or second aspect, wherein the web conveying direction separation distance between the first electrode and the other electrode is set by providing a web conveying roller entrained by the web between the first electrode and the other electrode, and setting the height and/or the external diameter of the web conveying roller.

A fourth aspect of the present invention is an electrolytic treatment device with an electrolytic treatment method for performing electrolytic treatment by conveying a web at a specific conveying velocity along a specific direction and applying an alternating current to plural electrodes disposed along the conveying direction of the web. In the electrolytic treatment device, the web conveying velocity, frequencies of alternating current applied to a first electrode and another electrode and web conveying direction separation distance between the first electrode and the other electrode are set such that the alternating current and voltage waveform applied to the web when a point on the web passes the far end of the first electrode and the alternating current and voltage waveform applied to the web when the point passes the near end of the other electrode adjacent on the downstream side of the first electrode do not reinforce each other.

A fifth aspect of the present invention is the electrolytic treatment device according to the fourth aspect, wherein the web is a web of either pure aluminum or an aluminum alloy.

A sixth aspect of the present invention is the electrolytic treatment device according to the fourth or fifth aspect, wherein the web conveying direction separation distance between the first electrode and the other electrode is set by providing a web conveying roller entrained by the web between the first electrode and the other electrode, and setting the height and/or the external diameter of the web conveying roller.

Advantageous Effects of Invention

In the electrolytic treatment method according to the first aspect, the alternating current and voltage waveform applied to the web at the far end of the first electrode and the alternating current and voltage waveform applied to the web at the near end of the other electrode do not reinforce each other. In other words, alternating current and voltage of the same phase angle is not applied both at the far end of the first electrode and the near end of the other electrode. Accordingly, since a similar electrochemical reaction does not occur at the same given location of the web at the far end of the first electrode and the near end of the other electrode, even if chatter marks were to occur on the web at the far end of the first electrode, these chatter marks are at least not further emphasized at the near end of the other electrode, thereby suppressing visibly distinct chatter marks from occurring.

According to the electrolytic treatment method of the second aspect, planographic printing plate supports can be fabricated without chatter marks.

According to the electrolytic treatment method of the third aspect, since the web conveying direction separation distance between the first electrode and the other electrode is set by setting the height or external diameter of the web conveying roller, this enables conditions to be set such that chatter marks do not occur without having to alter the web conveying velocity, alternating current frequency, and phase difference of alternating current between the first electrode and the other electrode. Consequently, fabrication of pure aluminum or aluminum alloy planographic printing plate supports without chatter marks can be readily accomplished.

In the electrolytic treatment device of the fourth aspect, as stated in the first aspect, the alternating current and voltage waveform applied to the web at the far end of the first electrode and the alternating current and voltage waveform applied to the web at the near end of the other electrode do not reinforce each other. In other words, alternating current and voltage of the same phase angle is not applied both at the far end of the first electrode and the near end of the other electrode. Accordingly, since a similar electrochemical reaction does not occur at the same given location of the web at the far end of the first electrode and the near end of the other electrode, visibly distinct chatter marks are suppressed from occurring.

According to the electrolytic treatment device of the fifth aspect, fabrication of planographic printing plate supports without chatter marks can be readily accomplished.

In the electrolytic treatment device according to the sixth aspect, since the web conveying direction separation distance between the first electrode and the other electrode is set by setting the height or external diameter of the web conveying roller, conditions can be set such that chatter marks do not occur without having to alter the web conveying velocity, alternating current frequency, and phase difference of alternating current between the first electrode and the other electrode. Consequently, after fabricating planographic printing plate supports, fabrication of planographic printing plate supports without chatter marks can be readily accomplished without having to reset the above conditions.

BEST MODE FOR CARRYING OUT THE INVENTION

Detailed explanation now follows regarding an example of exemplary embodiments of the present invention, with reference to the drawings.

1. First Exemplary Embodiment

Explanation follows regarding an example of the present invention applied to a radial electrolytic roughening treatment device for electrolytic roughening treatment by subjecting an aluminum web, an aluminum plate of continuous strip shape, to alternating current electrolysis.

Figure 1:
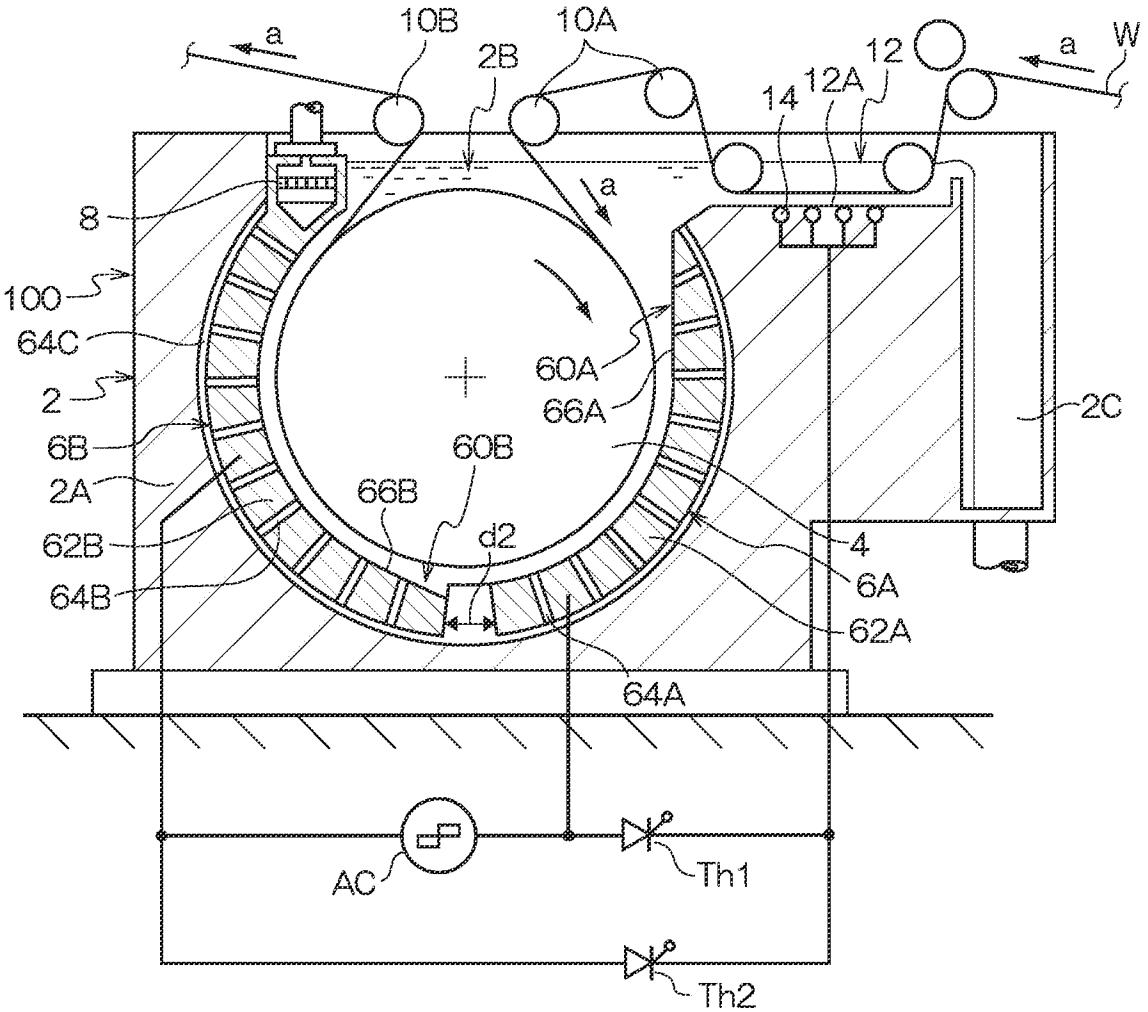
FIG. 1 is an outline cross-section showing a configuration of an electrolytic surface roughening treatment device according to a first exemplary embodiment.

As shown in FIG. 1, an electrolytic surface roughening treatment device 100 includes an electrolysis tank body 2 with internally provided electrolysis tank 2A filled with an acidic electrolyte solution, and a feed roller 4 disposed in the electrolysis tank 2A so as to be rotatable about an axis extending in a horizontal direction, for feeding an aluminum web W in the arrow a direction, namely from the right hand side towards the left hand side in FIG. 1. The aluminum web W here serves as an example of the web of the present invention.

The inner wall face of the electrolysis tank 2A is formed in a substantially circular cylindrical shape so as to surround the feed roller 4, with an upstream electrode 6A and a downstream electrode 6B, each semi-circular cylindrical shaped, provided between the inside wall face of the electrolysis tank 2A and the feed roller 4. The upstream electrode 6A is disposed on the upstream side with respect to the conveying direction a, and the downstream electrode 6B is disposed at the downstream side along the conveying direction a. The upstream electrode 6A and the downstream electrode 6B respectively correspond to the first electrode and other electrode of the present invention.

The upstream electrode 6A and the downstream electrode 6B are respectively divided into plural small electrodes 62A and 62B along their respective circumferential directions, with insulating layers 64A and 64B installed between each of the electrodes 62A and 62B. The small electrodes 62A and 62B can be formed, for example, from graphite or a metal, and the insulating layers 64A and 64B can be formed, for example, from polyvinyl chloride resin or the like. The thickness of the insulating layers 64A and 64B is preferably 1 to 10 mm. While omitted from FIG. 1, both the upstream electrode 6A and the downstream electrode 6B the small electrodes 62A and 62B are respectively connected to AC power supply. The small electrodes 62A and 62B and the insulating layers 64A and 64B are formed to the upstream electrode 6A or the downstream electrode 6B supported by an insulating electrode holder 64C.

The AC power supply has the function of supplying an alternating waveform current to the upstream electrode 6A and the downstream electrode 6B, and is also capable of controlling the voltage, frequency and phase of the alternating current being output. Examples of AC power supply include: a sine wave generating circuit that generates a sine wave by current-voltage rectification of a commercial alternating current using an induction voltage modulator or transformer; a thyristor circuit for generating a trapezoidal wave current or square wave current from a direct current obtained by means for rectifying a commercial alternating current; and the like.

A separation distance d2 between the far end of the upstream electrode 6A and the near end of the downstream electrode 6B is set so as to give a relationship between the conveying velocity of the aluminum web W and the frequency and phase of alternating current output from the AC power supply such that the alternating current and voltage waveform applied to the aluminum web W at the far end of the upstream electrode 6A and the alternating current and voltage waveform applied to the aluminum web W the near end of the downstream electrode 6B do not reinforce each other. In other words, the separation distance d2 is set to give a large absolute value of phase difference therebetween. For example, the length along the web conveying path of the upstream electrode 6A in FIG. 1 is denoted d1 (mm), the frequency of the alternating current output from the AC power supply is denoted f (Hz) and the conveying velocity of the aluminum web W is denoted v (m/minute). If the time when the web passes the near end of the upstream electrode 6A is 0 then the time when the web passes the far end of the upstream electrode 6A is time t1 (seconds) and the time when the web passes the near end of the downstream electrode 6B t2 (seconds), and $$t1=0.06d1/v$$

$$t2=0.06(d1+d2)/v$$

Hence, since the phases of the alternating current applied at the upstream electrode 6A and at the downstream electrode 6B are opposite to each other, for a sine wave phase $\phi 1$ of the alternating current at the far end of the upstream electrode 6A and phase $\phi 2$ of the alternating current at the near end of the downstream electrode 6B, are, respectively:

$$\phi 1=\sin(2\pi f.t1)$$

$$\phi 2=-\sin(2\pi f.t2)$$

The meaning of "the waveforms do not reinforce" in the present application means that the phase difference $\phi 1-\phi 2$, between the phase $\phi 1$ of the alternating current at the far end of the upstream electrode 6A and the phase $\phi 2$ of the alternating current at the near end of the downstream electrode 6B, takes an absolute value and is not zero. To make the absolute value of the phase difference $\phi 1-\phi 2$ large, the separation distance d2 is set specifically such that the phase difference is 0.2 or greater, and preferably 0.7 or greater.

Note that alternatively to adjusting the separation distance d2, frequency f of the alternating current from the AC power supply and/or the conveying velocity v of the aluminum web W may be adjusted so as to satisfy the above equation.

An opening 2B is formed in the top section of the electrolysis tank 2A for introducing and dispatching the aluminum web W, which is a continuous strip shaped aluminum plate, serving as an example of a metal plate of the present invention, during alternating current electrolytic surface roughening treatment. An acidic electrolyte solution replenishment flow path 8 is provided to the opening 2B at the vicinity of the far end of the downstream electrode 6B on the downstream side for replenishing the acidic electrolyte solution in the electrolysis tank 2A. A nitric acid solution, a hydrochloric acid solution or the like can be used as the acidic electrolyte solution.

A set of upstream side guide rollers 10A for guiding the aluminum web W into the electrolysis tank 2A, and a downstream side guide roller 10B for guiding the aluminum web W that has been subjected to electrolytic treatment in the electrolysis tank 2A out of the electrolysis tank 2A, are disposed above the electrolysis tank 2A in the vicinity of the opening 2B.

An overflow tank 2C is provided in the electrolysis tank body 2 at the upstream side of the electrolysis tank 2A. The overflow tank 2C temporarily holds acidic electrolyte solution that has overflowed from the electrolysis tank 2A, and has the function of maintaining a constant head of solution in the electrolysis tank 2A.

An auxiliary electrolysis tank 12 is provided between the electrolysis tank 2A and the overflow tank 2C. The auxiliary electrolysis tank 12 is configured shallower than the electrolysis tank 2A, and is formed with a flat plane shaped bottom face 12A. Plural circular pillar shaped auxiliary electrodes 14 are provided on the bottom face 12A.

The auxiliary electrodes 14 are preferably electrodes formed from a high corrosion resistant metal, such as platinum or the like, or ferrite or the like. The auxiliary electrodes 14 may also be configured in flat plate shape.

The auxiliary electrodes 14 are connected in parallel to the upstream electrode 6A to the side of the AC power supply connected to the upstream electrode 6A, with a thyristor Th1 connected between the AC power supply and the auxiliary electrodes 14 such that during firing current flows in the direction towards the auxiliary electrodes 14 from the side of the AC power supply connected to the upstream electrode 6A.

The auxiliary electrodes 14 are also connected to the side of the AC power supply connected to the downstream electrode 6B through a thyristor Th2. The thyristor Th2 is connected such that during firing current flows in the direction from the side of the AC power supply connected to the downstream electrode 6B towards the auxiliary electrodes 14.

An anode current hence flows to the auxiliary electrodes 14 during firing of both the thyristor Th1 and the thyristor Th2. Accordingly, by controlling the phase of the thyristor Th1 and Th2, the current value of anode current flowing to the auxiliary electrodes 14 can be controlled, and hence the ratio Qc/Qa can be controlled of a current amount Qc flowing when the aluminum web W is acting as a cathode and a current amount Qa when the aluminum web W is acting as an anode.

As shown in FIG. 1, there are asymptotic portions 66A and 66B formed at the upstream end portions of the upstream electrode 6A and the downstream electrode 6B with respect to the aluminum web W conveying direction a, each portion being respectively asymptotic to the feed roller 4 along the conveying direction a, with soft start portions 60A and 60B formed in the electrolysis tank 2A thereby.

The asymptotic portions 66A and 66B are formed as smooth planes in the electrolytic surface roughening treatment device 100 of the first exemplary embodiment, however they may be formed with convex or concave curved surfaces with respect to the surface of the feed roller 4, namely with respect to the conveying face T of the aluminum web W.

Explanation now follows regarding operation of the electrolytic surface roughening treatment device 100.

The aluminum web W that has been guided into the electrolysis tank body 2 from the right hand side of FIG. 1 is first introduced into the auxiliary electrolysis tank 12, then is next introduced into the electrolysis tank 2A by the upstream side guide rollers 10A. The aluminum web W is then fed by the feed roller 4 from the right hand side towards the left hand side in FIG. 1, and led out of the electrolysis tank 2A by the downstream side guide roller 10B.

The aluminum web W that has been introduced into the electrolysis tank 2A first passes through the soft start portion 60A. At the start point of the soft start portion 60A, the separation distance between the aluminum web W and the upstream electrode 6A is wider at the soft start portion 60A than the separation distance on the downstream side, hence the current density is much smaller than the maximum current density MCD in the electrolysis tank 2A.

On moving towards the downstream side along the soft start portion 60A, the current density flowing to the aluminum web W increases, and becomes equivalent to the maximum current density MCD by the time the end point of the soft start portion 60A is reached.

The aluminum web W that has passed through the soft start portion 60A is conveyed along the upstream electrode 6A, and an anodic or cathodic reaction occurs at the surface of the aluminum web W on the side facing the upstream electrode 6A according to the alternating waveform current applied from the AC power supply to the upstream electrode 6A.

After passing in the vicinity of the upstream electrode 6A, the aluminum web W next passes the soft start portion 60B. At the soft start portion 60B too, similarly to at the soft start portion 60A, as the aluminum web W moves towards the downstream side, the current density flowing to the aluminum web W increases, and by the time the end point of the soft start portion 60B is reached the current density is equivalent to that of the maximum current density MCD.

After passing the soft start portion 60B, the aluminum web W is similarly conveyed along the downstream electrode 6B, and an anodic or cathodic reaction occurs at the surface of the aluminum web W facing towards the downstream electrode 6B according to the alternating waveform current applied from the AC power supply to the downstream electrode 6B, thereby forming honeycomb pits over the entire surface of the aluminum web W.

In the electrolytic surface roughening treatment device 100 of the first exemplary embodiment, the separation distance d2, the power supply frequency f, and the conveying velocity V are set to achieve a large absolute value of the phase difference $\phi 1-\phi 2$, between the phase $\phi 1$ of the alternating current at the far end of the upstream electrode 6A and the phase $\phi 2$ of the alternating current at the near end of the downstream electrode 6B, or more specifically in order to achieve 0.2 or greater, and preferably 0.7 or greater. Accordingly, reinforcement of the alternating current and voltage waveform at the far end of the upstream electrode 6A and the near end of the downstream electrode 6B does not occur. Consequently, for example, even if chatter marks occur at a given location on the aluminum web W at the far end of the upstream electrode 6A, since a similar electrochemical reaction does not occur at the same given location of the aluminum web W at the near end of the downstream electrode 6B, the chatter marks are at least not further emphasized, and the chatter marks are usually eliminated.

In comparison thereto, when the absolute value of the phase difference $\phi 1-\phi 2$ is small, specifically when, for example, 0.15 or less, then since the alternating current and voltage waveform at the far end of the upstream electrode 6A and at the near end of the downstream electrode 6B reinforce each other, if chatter marks occur at a given location on the aluminum web W at the far end of the upstream electrode 6A, then a similar electrochemical reaction occurs at the same given location on the aluminum web W at the near end of the downstream electrode 6B, and so the chatter marks are emphasized.

Furthermore, since the soft start portions 60A and 60B are provided at the near ends of the upstream electrode 6A and the downstream electrode 6B, a current of low current density is initially applied to the aluminum web W on introduction to the electrolysis tank 2A. Accordingly, chatter marks can be efficiently suppressed from occurring even under conditions where chatter marks readily occur, at maximum current density and high speed conveying.

Detailed explanation now follows regarding a manufacturing method of a planographic printing plate support.

Manufacturing Method of Planographic Printing Plate Support

Aluminum Plate (Rolled Aluminum)

A known aluminum plate can be employed in the manufacturing method of a planographic printing plate support of the present invention. The aluminum plate employed in the present invention is made of a dimensionally stable metal composed primarily of aluminum, that is, aluminum or aluminum alloy. Aside from plates of pure aluminum, alloy plates composed primarily of aluminum and containing small amounts of other elements can also be used.

In the present specification, the various supports described above made of aluminum or aluminum alloy are referred to generically as aluminum plates. Other elements which may be present in the aluminum alloy include silicon, iron, copper, manganese, magnesium, chromium, zinc, bismuth, nickel, titanium and the like. The content of other elements in the alloy is not more than 10 wt %.

Aluminum plates that are suitable for use in the present invention are not specified here as to composition, and include, for example, known materials that appear in the $4^{th}$ edition of Aluminum Handbook (published in 1990 by the Japan Light Metal Association) such as, for example, aluminum plates having the designations JIS A1050, JIS A1100 and JIS A1070, and Mn containing Al—Mn based aluminum plates having the designation JIS A3004 and International Alloy Designation 3103A, and the like. To increase tensile strength, Al—Mg based alloys and Al—Mn—Mg based alloys (JIS A3005) composed of the above aluminum alloys to which at least 0.1 wt % of magnesium has been added can be employed. Al—Zr based alloys and Al—Si based alloys which additionally contain Zr and Si, respectively, can also be employed. Al—Mg—Si based alloys can also be employed.

An aluminum plate obtained by rolling a UBC (used beverage can) ingot made from melted used aluminum beverage cans can also be employed.

The Cu content in the aluminum plate is preferably 0.00 wt % or more, more preferably at least 0.01 wt % and even more preferably at least 0.02 wt % but is preferably 0.15 wt % or less, more preferably 0.11 wt % or less and even more preferably 0.03 wt % or less. An aluminum plate containing 0.07 to 0.09 wt % of Si, 0.20 to 0.29 wt % of Fe, not more than 0.03 wt % of Cu, not more than 0.01 wt % of Mn, not more than 0.01 wt % of Mg, not more than 0.01 wt % of Cr, not more than 0.01 wt % of Zn, not more than 0.02 wt % of Ti and not less than 99.5 wt % of A1 is particularly preferred.

The present applicant has described proposals for technology relating to JIS 1050 materials in JP-A Nos. 59-153861, 61-51395, 62-146694, 60-215725, 60-215726, 60-215727, 60-216728, 61-272367, 58-11759, 58-42493, 58-221254, 62-148295, 4-254545, 4-165041, Japanese Patent Application Publication (JP-B) No. 3-68939, JP-A No. 3-234594, JP-B No. 1-47545 and JP-A No. 62-140894. The technology described in JP-B Nos. 1-35910 and 55-28874 is also known.

The present applicant has described proposals for technology relating to JIS 1070 materials in JP-A Nos. 7-81264, 7-305133, 8-49034, 8-73974, 8-108659 and 8-92679.

The present applicant has described proposals for technology relating to Al—Mg based alloys in JP-B Nos. 62-5080, 63-60823, 3-61753, 60-203496, 60-203497, 3-11635, 61-274993, 62-23794, 63-47347, 63-47348, 63-47349, 64-1293, 63-135294, 63-87288, 4-73392, 7-100844, 62-149856, 4-73394, 62-181191, 5-76530, 63-30294, 6-37116. There is also description thereof in JP-A Nos. 2-215599 and 61-201747.

The present applicant has described proposals for technology relating to Al—Mn based alloys in JP-A Nos. 60-230951, 1-306288, 2-293189. Description is also given thereof in JP-B Nos. 54-42284, 4-19290, 4-19291, 4-19292, JP-A Nos. 61-35995, 64-51992, 4-226394, the specifications of U.S. Pat. Nos. 5,009,722 and 5,028,276 and the like.

The present applicant has described proposals for technology relating to Al—Mn—Mg based alloys in JP-A Nos. 62-86143 and 3-222796. There is also description thereof in the specifications of JP-B No. 63-60824, JP-A Nos.

60-63346, 60-63347, 1-293350, European Patent (EP) No. 223,737, U.S. Pat. No. 4,818,300, Great Britain Patent (GBP) No. 1,222,777 and the like.

The present applicant has described proposals for technology relating to Al—Zr based alloys in JP-B No. 63-15978 and JP-A No. 61-51395. There is also description thereof in JP-A Nos. 63-143234, 63-143235 and the like.

The present applicant has described proposals for technology relating to Al—Mg—Si based alloys in the specification and the like of GBP No. 1,421,710.

Methods such as the following, for example, can be employed for forming aluminum alloy into a plate. First, an aluminum alloy melt that has been adjusted to a given alloying ingredient content is subjected to cleaning treatment by an ordinary method and then cast. Cleaning treatment, which is performed to remove unnecessary gases from the melt, such as hydrogen and the like, is performed by: flux treatment; degassing treatment using argon gas, chlorine gas or the like; filtering treatment using, for example, what is referred to as a rigid media filter, such as ceramic tube filters, ceramic foam filters and the like, a filter that employs a filter medium such as alumina flakes, alumina balls and the like, or a glass cloth filter or the like; or a combination of degassing treatment and filtering treatment.

Cleaning treatment is preferably performed to prevent defects due to foreign matter such as nonmetallic inclusions, oxides and the like in the melt, and defects due to dissolved gases in the melt. The filtration of melts is described in JP-A Nos. 6-57432, 3-162530, 5-140659, 4-231425, 4-276031, 5-311261, 6-136466 and the like. The degassing of melts is described in JP-A No. 5-51659, Japanese Utility Model Application Laid-Open (JP-U) No. 5-49148 and the like. The present applicant has also described proposals for technology relating to the degassing of melts in JP-A No. 7-40017.

Next, casting is performed using the melt that has been subjected to cleaning treatment as described above. With respect to the casting method, both methods which use a stationary mold, as typified by DC casting methods, and those which use a moving mold, as typified by continuous casting methods, may be employed.

In DC casting, the melt is solidified at a cooling speed of 0.5 to 30° C./second. Sometimes there are many coarse intermetallic compounds formed at less than 1° C. When DC casting is performed, an ingot having a thickness of 300 to 800 mm can be produced. This ingot is scalped by a conventional method, as required, generally removing 1 to 30 mm of material from the surface, and preferably 1 to 10 mm. The ingot may also be soaked, either before or after scalping, as required. In cases where soaking is performed, the ingot is heat treated at 450 to 620° C. for 1 to 48 hours to prevent the coarsening of intermetallic compounds. The effects of soaking treatment are sometimes inadequate if heat treatment is shorter than one hour. Cases in which soaking treatment is not performed have the advantage that costs can be lowered.

The ingot is then hot-rolled and cold-rolled, giving a rolled aluminum plate. A temperature of 350 to 500° C. at the start of hot rolling is appropriate. Intermediate annealing may be performed before, after, or during hot rolling. Intermediate annealing conditions may be 2 to 20 hours of heating at 280 to 600° C., preferably 2 to 10 hours of heating at 350 to 500° C., in a batch-type annealing furnace, or of heating for up to 6 minutes at 400 to 600° C., preferably up to 2 minutes at 450 to 550° C., in a continuous annealing furnace. Using a continuous annealing furnace with a temperature rise rate of 10 to 200° C./second enables a finer crystal structure to be achieved.

The aluminum plate that has been finished by the above processes to a given thickness of, say, 0.1 to 0.5 mm may then also be flattened with a leveling machine such as a roller leveler, a tension leveler of the like. Flattening may be performed after the aluminum has been cut into discrete sheets, however it is preferably performed with the rolled aluminum in the state of a continuous coil to enhance productivity. The plate may also be passed through a slitter line to cut it to a predetermined width. A thin film of oil may be provided on the surface of the aluminum plate to prevent scuffing due to rubbing of aluminum plates against each other. Either a volatile or non-volatile oil film may be suitably employed, as required.

Industrially performed continuous casting processes include processes which use cooling rolls, as typified by the twin roll process (Hunter process) and the 3C process, a twin belt process (Hazelett process), and processes which use a cooling belt, typified by the Alusuisse Caster II mold, or a cooling block. When a continuous casting process is used solidification is at a cooling rate in the range of 100 to 1000° C./second. Continuous casting processes generally have a faster cooling rate than DC casting processes, and so are characterized by the ability to achieve a higher solid solubility by alloying of components in a aluminum matrix. Technology relating to continuous casting processes proposed by the present applicant is described in JP-A Nos. 3-79798, 5-201166, 5-156414, 6-262203, 6-122949, 6-210406, 6-26308 and the like.

When continuous casting is performed, such as by a process involving the use of cooling rolls, such as the Hunter process or the like, casting can be directly and continuously performed of a plate having a thickness of 1 to 10 mm, with the advantage of being able to omit the hot rolling step. Moreover, when use is made of a process that employs a cooling belt, such as the Hazelett process or the like, a plate having a thickness of 10 to 50 mm can be cast. Generally, by positioning a hot-rolling roll immediately after casting, the cast plate can then be successively rolled, enabling a continuously cast and rolled plate with a thickness of 1 to 10 mm to be obtained.

These continuously cast and rolled plates are then passed through such steps as cold rolling, intermediate annealing, flattening and slitting in the same way as described above for DC casting, and thereby finished to a specific plate thickness of, for example, 0.1 to 0.5 mm. Technology proposed by the present applicant relating to intermediate annealing conditions and cold rolling conditions in a continuous casting process is described in JP-A Nos. 6-220593, 6-210308, 7-54111, 8-92709 and the like.

The aluminum plate used in the present invention is preferably tempered in accordance with H18 defined in JIS.

It is desirable for the aluminum plate manufactured as described above to have the following properties.

With respect to the strength of the aluminum plate, in order to achieve the stiffness required of a planographic printing plate support, the aluminum plate should have a 0.2% offset yield strength of preferably at least 120 MPa. To ensure some degree of stiffness even when burning treatment has been performed, the 0.2% offset yield strength following 3 to 10 minutes of heat treatment at 270° C. should be preferably at least 80 mPa, and more preferably at least 100 MPa. In cases where a particularly stiff aluminum plate is required, an aluminum material containing Mg or Mn may be employed. However, because a higher stiffness is detrimental to the ease with which the plate can be fitted onto the plate cylinder of a printing press, the plate material and the amounts of minor components added thereto are suitably selected according to the intended application. Related technology proposed by the present applicant is described in JP-A Nos. 7-126820, 62-140894 and the like.

The aluminum plate more preferably has a tensile strength of 160±15 N/mm$^2$, a 0.2% offset yield strength of 140±15 MPa, and an elongation as specified in JIS Z2241 and Z2201 of 1 to 10%.

Due to the crystal structure at the surface of the aluminum plate sometimes giving rise to a poor surface quality when chemical surface roughening treatment or electrochemical surface roughening treatment is performed, it is preferable that the crystal structure is not be too coarse at the surface. The crystal structure at the surface of the aluminum plate has a width of preferably up to 200 μm, more preferably up to 100 μm, and most preferably up to 50 μm. Moreover, the crystal structure has a length of preferably up to 5,000 μm, more preferably up to 1,000 μm, and most preferably up to 500 μm. Related technology proposed by the present applicant is described in, for example, JP-A Nos. 6-218495, 7-39906, 7-124609 and the like.

It is preferable for the alloying ingredient distribution at the surface of the aluminum plate to be reasonably uniform because non-uniform distribution of alloying ingredients at the surface of the aluminum plate sometimes leads to a poor surface quality when chemical surface roughening treatment or electrochemical surface roughening treatment is performed.

With respect to intermetallic compounds of the aluminum plate, the size or density of intermetallic compounds in an aluminum plate may affect chemical surface roughening treatment or electrochemical surface roughening treatment. Related technology proposed by the present applicant is described in JP-A Nos. 7-138687, 4-254545 and the like.

In the present invention, the aluminum plate as described above can be used after asperities are formed thereon in the final rolling process or the like by press rolling, transfer or another method.

In particular, it is preferable to apply a method of forming a pattern of recessed and protruded portions on the surface of the aluminum plate by pressing a surface having a pattern of recessed and protruded portions onto the aluminum plate to transfer the pattern of recessed and protruded portions while performing cold rolling for adjusting the final plate thickness or finish cold rolling for finishing the surface profile after the final plate thickness has been adjusted. More specifically, the method described in JP-A No. 6-262203 can be appropriately employed.

By employing an aluminum plate having a pattern of recessed and protruded portions on the surface, it is possible to obtain a pattern of recessed and protruded portions with more uniform average pitches and depths compared to a pattern of recessed and protruded portions formed by use of brushes and an abrasive, enhancing resistance to soiling. Moreover, it is possible to reduce energy consumption in subsequent alkaline etching treatment and surface roughening treatment and to facilitate control of the amount of fountain solution on a printing press. For example, the etching amount can be reduced to about 3 g/m$^2$ or less in a first etching treatment to be described later. In addition, since a planographic printing plate support obtained by employing an aluminum plate having a pattern of recessed and protruded portions has an increased surface area, it also has good press life.

Transfer is particularly preferably performed onto the aluminum plate in the commonly performed final cold rolling process. The aluminum plate is preferably passed through rolls once to three times in rolling for transfer and the draft in each rolling process is preferably 3 to 8%.

Moreover, it is preferable to form the asperities on both surfaces of the aluminum plate by transfer. The stretch ratios on the front surface and the rear surface of the aluminum plate can be adjusted thereby to approximately the same degree, and it is accordingly possible to obtain an aluminum plate with good flatness.

Examples of methods for obtaining rolling rolls having asperities formed on the surfaces thereof for use in transferring recessed and protruded portions include blasting methods, electrolytic methods, laser methods, electrical discharge machining methods and combinations thereof. Among these, a method in which a blasting method is combined with an electrolytic method is preferable. Air blasting method is preferable from blasting methods. The air pressure applied in the air blasting method is preferably 1 to 10 kgf/cm$^2$ ($9.81\times10^4$ to $9.81\times10^5$ Pa) and more preferably 2 to 5 kgf/cm$^2$ ($1.96\times10^5$ to $4.90\times10^5$ Pa).

As long as alumina particles having a specific particle size are used there is no particular limitation to grit employed in the air blasting method. Deep and uniform asperities are readily formed on the surfaces of the transfer rolls when hard alumina particles, each having sharp edges, are used for the grit.

The alumina particles have an average particle size of 50 to 150 μm, preferably 60 to 130 μm and more preferably 70 to 90 μm. When the alumina particles fall within the above ranges, a sufficiently large surface roughness for the transfer roll is obtained and hence the aluminum plate imparted with asperities using this transfer roll has a sufficiently large surface roughness. The number of pits formed can be also significantly increased.

When performing an air blasting method, it is preferable to perform two to five blasts, and more preferably two blasts. When two blasts are performed, the second blast is capable of scraping irregular projections off the asperities formed in the first blast, thus lessening the likelihood of deep recesses being formed on the surface of the aluminum plate imparted with asperities using the thus obtained rolling rolls. As a result, a planographic printing plate obtained therefrom is excellent in developability (sensitivity).

The blast angle in an air-blasting method is preferably 60 to 120° with respect to the surface onto which air is blasted (roll surface), and more preferably 80 to 100°.

It is preferable to perform polishing after air blasting treatment but before plating treatment, described later, until the average surface roughness (Ra) is reduced by 10 to 40% from the value obtained after the air blasting. Polishing is preferably performed with sandpaper, a grindstone or a buff. By polishing, the projections on the surface of the transfer roll can be evened out in height so that locally deep areas are not formed on the surface of an aluminum plate imparted with asperities using a transfer roll. As a result, a planographic printing plate obtained therefrom is excellent in developability (sensitivity).

The surface of the transfer roll preferably has an average surface roughness (Ra) of 0.4 to 1.0 μm and more preferably 0.6 to 0.9 μm. The number of peaks on the surface of the transfer roll is preferably 1000 to 40,000 peaks/mm$^2$ and more preferably 2000 to 10,000 peaks/mm$^2$. When the number of peaks is too small, the water retention ability of the planographic printing plate support and its adhesion to the image recording layer are impaired. Impaired water retention ability causes scumming to more readily occur in halftone dot areas when the support has been formed into a planographic printing plate.

There is no particular limitation on the material of a transfer roll and, for example, any known material for rolling rolls can be used.

Steel rolls are preferable employed in the present invention. Rolls fabricated by forging are particularly preferable from among such rolls. A preferable example of the composition of the roll material is as follows: C: 0.07 to 6 wt %; Si: 0.2 to 1 wt %; Mn: 0.15 to 1 wt %; P: not more than 0.03 wt %; S: not more than 0.03 wt %; Cr: 2.5 to 12 wt %; Mo: 0.05 to 1.1 wt %; Cu: not more than 0.5 wt %; V: not more than 0.5 wt %, the balance: iron and inevitable impurities.

Other examples of the materials that may be employed include steels generally be used in rolling rolls, including tool steels (SKD), high-speed tool steels (SKH), high-carbon chromium-type bearing steels (SUJ), and forged steels containing carbon, chromium, molybdenum and vanadium as alloying elements. To achieve a long roll life, high-chromium alloy cast iron containing about 10 to 20 wt % of chromium may be used. A roll fabricated by forging is particularly preferably employed among these. In this case, the roll preferably has a hardness (Hs) of 80 to 100 after quenching and tempering have been performed. Tempering is preferably performed at a low temperature.

The roll diameter is preferably 200 to 1000 mm. The roll surface length is preferably 1000 to 4000 mm.

A transfer roll having asperities formed on the surface thereof by the air blasting method or the like is preferably subjected to a hardening treatment such as quenching or hard chromium plating after the transfer roll is rinsed. The wear resistance is thereby enhanced and the service life of the transfer roll prolonged.

Hard chromium plating is particularly preferable as a hardening treatment. Hard chromium plating can be performed with an electroplating method using a $CrO^3$—$SO^4$ bath, a $CrO^3$—$SO^4$-fluoride bath or the like, this being a conventionally known industrial chromium plating method.

The thickness of layer formed by the hard chromium plating is preferably 3 to 15 μm, and more preferably 5 to 10 μm. When the thickness falls within this range, plating peel off, where the plated layer peels off at the boundary between the roll surface base and the plating layer, less readily occurs, and there is also sufficient wear resistance enhancement. The thickness of the layer formed by the hard chromium plating can be controlled through adjustment during plating.

Before a roll is subjected to hard chromium plating, the roll is preferably subjected to electrolytic treatment in the plating solution for use in the hard chromium plating, with the roll set as the anode and a direct current employed with a quantity of electricity in the range of 5000 to 50,000 C/dm$^2$. Asperities on the roll surface can thereby be made more uniform.

The aluminum plate used in this invention is in the form of a continuous strip or discrete sheets. Namely, it may be either an aluminum web or individual sheets cut to a size corresponding to the planographic printing plate precursors that will be shipped as the final product.

Because scratches on the surface of the aluminum plate may become defects when the plate is fabricated into a planographic printing plate support, there is a requirement to minimize scratches from occurring prior to the surface treatment operations for forming the aluminum plate into a planographic printing plate support. The aluminum plate is therefore preferably stably packed in such a manner that it will not be easily damaged during transport. When in the form of an aluminum web, the aluminum may be packed by, for example, laying hardboard and felt on an iron pallet, placing cardboard doughnuts at both ends of the product, and wrapping the entirety in polytubing, inserting a wooden doughnut into the opening at the center of the coil, stuffing felt around the periphery of the coil, tightening steel strapping about the entire package, and labeling the exterior. In addition, polyethylene film can be used as wrapping material, and needled felt and hardboard can be used as the cushioning material. Various other forms of packing exist, any of which may be used so long as the aluminum plate can be stably transported without being scratched.

The aluminum plate used in the present invention has a thickness of about 0.1 to 0.6 mm, preferably 0.15 to 0.4 mm, and more preferably 0.2 to 0.3 mm. This thickness can be changed as appropriate based on such considerations as the size of the printing press, the size of the printing plate and the desires of a user.

Surface Treatment

In the method of manufacturing a planographic printing plate support of the present invention, the aluminum plate described above is subjected an electrochemical surface roughening treatment in which an alternating current is passed through the aluminum plate in an electrolyte, to obtain a planographic printing plate support.

The method of manufacturing a planographic printing plate support in the present invention may also include various other processes than the above treatments.

More specifically, for example, a method is preferably used in which etching treatment in an aqueous alkali solution (first etching treatment), desmutting treatment in an aqueous acidic solution, electrochemical surface roughening treatment, etching treatment in an aqueous alkali solution (second etching treatment), desmutting treatment in an aqueous acidic solution, and anodizing treatment are performed in this order.

Furthermore, a further electrochemical surface roughening treatment, etching treatment in an aqueous alkali solution, and desmutting treatment in an aqueous acidic solution may be performed prior to performing the anodizing treatment in the above method. Another method in which sealing treatment or hydrophilizing treatment, or sealing treatment then hydrophilizing treatment, are performed after the anodizing treatment is also preferable.

Mechanical surface roughening treatment can be performed before the first etching treatment. This enables the amount of electricity used in the electrochemical surface roughening treatment to be reduced.

Mechanical surface roughening treatments include, for example, wire brush graining methods in which the surface of an aluminum plate is scuffed with metal wire, a ball graining method in which the surface of an aluminum plate is grained with abrasive balls and an abrasive, and a brush graining method in which the surface is grained with nylon brushes and an abrasive as described in JP-A No. 6-135175 and JP-B No. 50-40047.

A transfer method in which a surface with asperities is pressed onto an aluminum plate (transfer roll method) can be also employed. Namely, applicable methods include those described in JP-A Nos. 55-74898, 60-36195 and 60-203496, as well as a method described in JP-A No. 6-55871 featuring repeated transfer several times, and a method described in JP-A No. 6-24168 featuring a surface with elastic properties.

Among these, the transfer roll method is preferable because this method is readily compatible with increasing speeds of processes for manufacturing a planographic printing plate support. As described above, it is preferable in the transfer roll method to perform transfer during cold rolling for adjusting the final plate thickness or during finish cold rolling for finishing the surface profile after the final plate thickness has been adjusted.

Detailed explanation now follows regarding each of the surface treatment processes.

First Etching Treatment

Alkali etching treatment is a treatment in which the surface layer of an aluminum plate as described above is dissolved by bringing the aluminum plate into contact with an alkali solution.

The first etching treatment is preferably performed prior to the electrochemical surface roughening treatment. The first etching treatment is performed in order to enable the formation of uniform recesses in the electrochemical surface roughening treatment and to remove substances such as rolling oil, contaminants, a naturally oxidized film and the like from the surface of the aluminum plate (rolled aluminum).

In the first etching treatment, the etching amount from the surface to be subsequently subjected to the electrochemical surface roughening treatment is preferably at least 0.5 $g/m^2$, more preferably at least 1 $g/m^2$, but preferably not more than 10 $g/m^2$, and more preferably not more than 5 $g/m^2$. With an etching amount of 0.5 $g/m^2$ or more, uniform pits can be formed in the subsequent electrochemical surface roughening treatment. With an etching amount of 10 $g/m^2$ or less, the amount of aqueous alkali solution used is decreased, with this being economically advantageous.

The etching amount from the rear side with respect to the surface to be subsequently subjected to the electrochemical surface roughening treatment is preferably at least 5% of the etching amount from the surface to be subjected to the electrochemical surface roughening treatment, more preferably at least 10%, but preferably not more than 50% and more preferably not more than 30%. Within the above ranges, a suitable balance can be struck between the effectiveness of rolling oil removal from the rear side of the aluminum plate and economic efficiency.

Similar considerations apply to the second and third etching treatments, described later.

Alkalis that may be used in the alkali solution include, for example, caustic alkalis and alkali metal salts. Specific examples of suitable caustic alkalis include sodium hydroxide and potassium hydroxide. Specific examples of suitable alkali metal salts include: alkali metal silicates such as sodium metasilicate, sodium silicate, potassium metasilicate and potassium silicate; alkali metal carbonates such as sodium carbonate and potassium carbonate; alkali metal aluminates such as sodium aluminate and potassium aluminate; alkali metal aldonates such as sodium gluconate and potassium gluconate; and alkali metal hydrogenphosphates such as sodium secondary phosphate, potassium secondary phosphate, sodium primary phosphate and potassium primary phosphate. Of these, caustic alkali solutions and solutions containing both a caustic alkali and an alkali metal aluminate are preferred on account of their high etch rate and low cost. An aqueous solution of sodium hydroxide is especially preferred.

In the first etching treatment, the alkali solution preferably has a concentration of at least 1 wt %, and more preferably at least 20 wt %, but preferably not more than 35 wt %, and more preferably not more than 30 wt %.

It is desirable for the alkali solution to contain aluminum ions. The aluminum ion concentration is preferably at least 0.5 wt %, and more preferably at least 4 wt %, but preferably not more than 10 wt %, and more preferably not more than 8 wt %. Such an alkali solution can be prepared from, for example, water, a 48 wt % solution of sodium hydroxide in water, and sodium aluminate.

In the first etching treatment, the alkali solution temperature is preferably at least 25° C., and more preferably at least 40° C., but preferably not more than 95° C., and more preferably not more than 80° C.

The treatment time in the first etching treatment is preferably at least 1 second, and more preferably at least 2 seconds, but preferably not more than 30 seconds, and more preferably not more than 15 seconds.

As the aluminum plate is being continuously etched, the aluminum ion concentration in the alkali solution rises and the amount of material etched from the aluminum plate changes. It is thus preferable to control the etching solution composition as follows.

First, a matrix of the electrical conductivity, specific gravity and temperature, or a matrix of the conductivity, ultrasonic wave propagation velocity and temperature, is prepared with respect to a matrix of the sodium hydroxide concentration and the aluminum ion concentration. The solution composition is then measured based on either the conductivity, specific gravity and temperature, or on the conductivity, ultrasonic wave propagation velocity and temperature, and sodium hydroxide and water are added so as to achieve target values for the solution composition. Next, the etching solution which has increased in volume with the addition of sodium hydroxide and water is allowed to overflow from a circulation tank, thereby maintaining a constant amount of solution. Industrial grade 40 to 60 wt % sodium hydroxide can be employed as the sodium hydroxide for addition.

The conductivity meter and hydrometer used to measure electrical conductivity and specific gravity, respectively, are preferably each temperature-compensated instruments. The hydrometer employed is preferably a pressure differential hydrometer.

Examples of methods for bringing the aluminum plate into contact with the alkali solution include, for example, a method in which the aluminum plate is passed through a tank filled with an alkali solution, a method in which the aluminum plate is immersed in a tank filled with an alkali solution, and a method in which the surface of the aluminum plate is sprayed with an alkali solution.

From these methods, the method involving spraying the surface of the aluminum plate with an alkali solution is preferable. More specifically, a method by which the etching solution is sprayed onto the aluminum plate at a rate of 10 to 100 L/min per spray line from spray lines bearing 2 to 5 mm diameter openings at a pitch of 10 to 50 mm is especially desirable. Preferably plural spray lines are provided.

Following the completion of alkali etching treatment, preferably the etching solution is removed from the aluminum plate with nip rollers, the plate is subjected to rinsing treatment with water for 1 to 10 seconds, then water removed with nip rollers. Rinsing treatment is preferably performed by rinsing with a rinsing apparatus that uses a free-falling curtain of water, and by also rinsing with spray lines.

Alternatively, rinsing can be performed, for example, with a spray line having plural spray tips that discharge fan shaped sprays of water and are disposed along the width of the aluminum plate. The interval between the spray tips is preferably 20 to 100 mm, and the amount of water discharged per spray tip is preferably 0.5 to 20 L/min. Preferably plural spray lines are employed.

First Desmutting Treatment

After the first etching treatment has been performed, preferably acid pickling (first desmutting treatment) is performed to remove contaminants (smut) remaining on the surface of the aluminum plate. Desmutting treatment is performed by bringing an acidic solution into contact with the aluminum plate.

Examples of acids that may be used include nitric acid, sulfuric acid, hydrochloric acid, phosphoric acid, chromic acid, hydrofluoric acid and hydrofluoboric acid. Among these, nitric acid and sulfuric acid are preferable. More specifically, for example, wastewater from the aqueous sulfuric acid solution used in the anodizing treatment step, described later, can be preferably used.

In order to control the composition of the desmutting treatment solution, selection can be made from a method in which the electrical conductivity and temperature are controlled with respect to a matrix of the acidic solution concentration and the aluminum ion concentration, a method in which the electrical conductivity, specific gravity and temperature are controlled with respect to the above matrix, or a method in which the electrical conductivity, ultrasonic wave propagation velocity and temperature are controlled with respect to the above matrix.

In the first desmutting treatment, it is preferable to use an acidic solution containing 0.5 to 30 wt % of an acid and 0.5 to 10 wt % of aluminum ions.

The temperature of the acidic solution is preferably in the range of from 25° C. to 95° C.

Treatment time in the first desmutting treatment is preferably at least 1 second, and more preferably at least 2 seconds, but preferably not more than 30 seconds, and more preferably not more than 10 seconds.

Examples of methods for bringing the aluminum plate into contact with the acidic solution include passing the aluminum plate through a tank filled with the acidic solution, immersing the aluminum plate in a tank filled with the acidic solution, and spraying the acidic solution onto the surface of the aluminum plate.

From these methods, a method in which the acidic solution is sprayed onto the surface of the aluminum plate is preferred. Specifically, a method in which a desmutting solution is sprayed from spray lines bearing 2 to 5 mm diameter openings and spaced at a pitch of 10 to 50 mm, at a rate of 10 to 100 L/min per spray line is desirable. Preferably plural such spray lines are provided.

After desmutting treatment has been completed, preferably the solution is removed with nip-rollers, then after performing rinsing treatment with water for 1 to 10 seconds duration, removing the water with nip rollers.

Rinsing treatment is the similar to the rinsing treatment following alkali etching treatment. However, preferably the amount of water used per spray tip is from 1 to 20 L/min.

Electrochemical Surface Roughening Treatment

For the electrochemical surface roughening treatment, preferably electrochemical surface roughening treatment is employed in which an alternating current is passed through while in an aqueous solution containing hydrochloric acid and nitric acid. The electrochemical surface roughening treatment is capable of obtaining an aluminum plate having a surface profile with few plateau portions (flats), preferably with uniform recesses having an average diameter of 2 to 20 μm, and preferably an average surface roughness of 0.3 to 8 μm. Since there are few plateau portions on the surface after the electrochemical surface roughening treatment has been performed, the planographic printing plate obtained therefrom has a long press life. Further, since the pits are uniformly, the planographic printing plate obtained therefrom has excellent scumming resistance.

The concentration of hydrochloric acid or nitric acid in the electrolyte is preferably 3 to 30 g/L, more preferably 4 to 20 g/L and even more preferably 10 to 18 g/L. When the concentration falls within the above ranges, uniformity of the pits formed is enhanced.

Aqueous mixtures can also be employed with an added nitrate compound containing nitrate ions, such as aluminum nitrate, sodium nitrate, ammonium nitrate or the like, or chloride compound containing chloride ions such as aluminum chloride, sodium chloride or ammonium chloride. A compound which forms a complex with copper may also be added in a proportion of 1 to 200 g/L. Sulfuric acid may also be added. The aqueous mixture may have dissolved therein metals which are present in the aluminum alloy, such as iron, copper, manganese, nickel, titanium, magnesium and silicon. Hypochlorous acid and hydrogen peroxide may also be added in an amount of 1 to 100 g/L.

The aluminum ion concentration in the aqueous mixture is preferably 3 to 30 g/L, more preferably 3 to 20 g/L and even more preferably 8 to 18 g/L. When the aluminum ion concentration falls within the above ranges, uniformity of the pits formed is enhanced. The replenishment amount of the aqueous mixture is not increased too much.

It is preferable to perform concentration control of each component of the electrolyte using a concentration measuring method such as a multi-component concentration measuring method in combination with feedforward control and feedback control. Correct concentration control of the electrolyte is thereby enabled.

Examples of multi-component concentration measuring method include a method in which the concentration is measured using the ultrasonic wave propagation velocity in the liquid and the electrical conductivity (specific electrical conductivity) of the liquid, neutralization titration, capillary electrophoretic analysis, isotachophoretic analysis and ion chromatography. Depending on the type of a detector used, the ion chromatography is classified into ion chromatography for absorbance detection, non-suppressor type ion chromatography for conductivity detection and suppressor type ion chromatography. Among these, the suppressor type ion chromatography is preferable because the measurement stability is ensured.

More specifically, the concentration of each component of the electrolyte solution is preferably controlled by the method described below.

As electrochemical surface roughening treatment is being performed, the hydrogen ion concentration of the electrolyte solution falls and the aluminum ion concentration increases in proportion to the amount of electricity applied. Therefore, by performing feedforward control based on the amount of electricity applied enables the hydrogen ion concentration and the aluminum ion concentration to be kept constant.

In other words, acid is replenished to the electrolyte solution in an amount corresponding to the amount of electricity applied, namely the value of current generated by the AC power supply in order to raise the hydrogen ion concentration, and water is replenished to the electrolyte solution in an amount corresponding to the amount of electricity applied in order to decrease the aluminum ion concentration. Additional acid is also replenished to the electrolyte solution in an amount corresponding to the amount of water added, in order to compensate for the decrease of the acid concentration due to the addition of water. Accordingly, the hydrogen ion concentration and the aluminum ion concentration can be kept constant. In the following description, water replenished to the electrolyte solution is also referred to as replenishment water.

It is also preferable to control the concentration of each component of the electrolyte solution by providing a concentration measuring system for measuring the concentration of each component of the electrolyte solution, used in combination with feedback control in which the supply of the acid and replenishment water is controlled based on the measured component concentration of the electrolyte solution. The combined use of feedback control enables good control of the concentration of the electrolyte solution even in cases such as when electrolyte solution of a previous step brought in or taken out with the aluminum plate, electrolyte solution evaporation occurs, or the like.

An example of concentration measuring method is a multi-component concentration measuring method such as mentioned above. Particularly preferred is a method in which the relationship between how the electrical conductivity and the ultrasonic wave propagation velocity of the electrolyte solution correspond to the compositional ratio of the respective components in the solution is established in advance, and the concentration measurement is performed based on the values of the electrical conductivity and ultrasonic wave propagation velocity.

The replenishment water and the acid are preferably supplied to a circulation tank. The circulation tank stores the electrolyte solution, the electrolyte solution stored in the circulation tank is supplied to an electrolysis tank, and the circulation tank stores electrolyte solution discharged from the electrolysis tank. When the electrolyte solution exceeds the capacity of the circulation tank, the electrolyte solution overflows and is discharged. Note that the discharged electrolyte solution may be disposed of as wastewater into a river or the like after having been made harmless.

The amount of electricity in the electrochemical surface roughening treatment is preferably in the range of 150 to 800 C/dm$^2$ in terms of the total amount of electricity during the time when the aluminum plate serves as an anode, preferably 200 to 700 C/dm$^2$, and more preferably 200 to 500 C/dm$^2$. When the amount of electricity is at least 150 C/dm$^2$, a superior product having sufficient surface roughness and a longer press life is obtained and the amount of water during printing can be more easily adjusted. As long as the amount of electricity is not more than 800 C/dm$^2$ a product having more excellent scumming resistance is obtained. 200 to 400 C/dm$^2$ is particularly preferable when employing an aluminum plate formed with a pattern of recessed and protruded portions.

The current density in the electrochemical surface roughening treatment at the peak current value is preferably 10 to 300 A/dm2, more preferably 20 to 200 A/dm$^2$ and even more preferably 30 to 100 A/dm$^2$. Productivity is further enhanced when the current density is at least 10 A/dm$^2$. As long as the current density is not more than 300 A/dm$^2$, the voltage is not so high and the capacity of the power supply is not increased too much, enabling the cost of the power supply to be decreased.

The current density is preferably set so as to gradually increase from initiation of electrolysis treatment to completion. Generation of uniform pits is facilitated thereby. Specifically, it is preferable to set the power supply and division of electrodes such that the value of (final electrolysis current density/initial electrolysis current density) is gradually increased in stages to a value of 1.1 to 2.0.

The electrochemical surface roughening treatment may be performed in accordance with, for example, the electrochemical graining processes (electrolytic graining processes) described in JP-B No. 48-28123 and GBP No. 896,563.

Various electrolysis tanks and power supplies have been proposed for use in electrolytic treatment. For example, use may be made of those described in U.S. Pat. No. 4,203,637, JP-A Nos. 56-123400, 57-59770, 53-12738, 53-32821, 53-32822, 53-32823, 55-122896, 55-132884, 62-127500, 1-52100, 1-52098, 60-67700, 1-230800 and 3-257199. Those described in the following may also be employed: JP-A Nos. 52-58602, 52-152302, 53-12738, 53-12739, 53-32821, 53-32822, 53-32833, 53-32824, 53-32825, 54-85802, 55-122896 and 55-132884, JP-B Nos. 48-28123 and 51-7081, and JP-A Nos. 52-133838, 52-133840, 52-133844, 52-133845, 53-149135 and 54-146234.

Furthermore, uniform graining of an aluminum plate containing a large amount of Cu is made possible by adding and using a compound with capability to form a complex with Cu. Examples of such compounds capable of forming a complex with Cu include, for example: ammonia; amines obtained by substituting a hydrogen atom of ammonia with an (aliphatic or aromatic) hydrocarbon group or the like, such as by methylamine, ethylamine, dimethylamine, diethylamine, trimethylamine, cyclohexylamine, triethanolamine, triisopropanolamine and EDTA (ethylenediaminetetraacetic acid); and metal carbonates such as sodium carbonate, potassium carbonate and potassium hydrogencarbonate. Ammonium salts such as ammonium nitrate, ammonium chloride, ammonium sulfate, ammonium phosphate and ammonium carbonate are also included.

The temperature of the electrolyte aqueous solution is preferably at least 20° C., more preferably at least 25° C. and even more preferably at least 30° C., but is preferably not more than 60° C., more preferably not more than 50° C. and even more preferably not more than 40° C. As long as the temperature is at least 20° C., the costs for operating a refrigerator for cooling are not too high and the amount of ground water used for cooling can be suppressed. Making the temperature not more than 60° C. facilitates ensuring adequate corrosion resistance of the equipment.

No particular limitation is imposed on the alternating current power supply waveform used in the electrochemical surface roughening treatment. For example, a sinusoidal, square, trapezoidal or triangular waveform may be used, but a trapezoidal or sinusoidal waveform is preferred and a sinusoidal waveform is more preferred.

When a sinusoidal waveform is used, a commercial alternating current or other current which has substantially a sinusoidal waveform can be used without any particular limitation.

The alternating current has preferably a duty ratio (a value obtained by dividing the anodic reaction time of the aluminum plate in one cycle by the duration of one cycle) of 0.33 to 0.66 and more preferably 0.45 to 0.55.

The alternating current used in the electrochemical surface roughening treatment preferably has a frequency in the range of 10 to 200 Hz, more preferably 20 to 150 Hz and even more preferably 30 to 120 Hz. As long as the frequency is 10 Hz or more, facet-shaped (angulated square shaped) large pits do not readily form and more excellent scumming resistance is achieved. When the frequency is not more than 200 Hz, the current condition is not susceptible to being affected by inductance components of a power circuit through which an electrolytic current passes, facilitating production of a high-capacity power supply.

For example, as a power supply device, one using a commercial alternating current or an inverter-controlled power supply can be used. Among these, an inverter-controlled power supply using an IGBT (Insulated Gate Bipolar Transistor) is preferable due to excellent tracking capability when the current value (current density of the aluminum plate) is kept constant varying the voltage according to the width and thickness of the aluminum plate and fluctuations in the concentration of each component in the electrolyte solution.

One or more alternating current power supply can be connected to each electrolysis tank.

Any known electrolysis tank employed for surface treatment, including a vertical type in addition to the radial type described above, may be employed as the electrolysis tank for electrochemical surface roughening treatment, however radial electrolysis tanks such as those described in JP-A No. 5-195300 are preferred from the perspective that pits can be prevented from occurring on the rear surface of an aluminum plate during electrochemical surface roughening treatment.

When using a flat type electrolysis tank, it is preferable to adopt a method in which an insulating plate is provided on the non-treatment surface of the aluminum plate to prevent a current from passing over the non-treatment surface, in order to thereby prevent pit formation occurring on the rear of the aluminum plate during electrochemical surface roughening treatment.

The electrolyte solution may be passed through the electrolysis tank either parallel or counter to the direction in which the aluminum web advances, however the counter direction is preferable.

It is desirable to increase the movement velocity of the aluminum plate when performing electrochemical surface roughening treatment of the aluminum plate, in order to raise productivity. The length over which electrochemical surface roughening treatment is performed, namely the treatment length, needs to be lengthened in order to speed up the movement velocity of the aluminum plate.

A method employing an increased size of electrolysis tank may be employed as a method of increasing the treatment length, however since there are problems associated with production of large-scale electrolysis tanks, a preferable mode is one that employs plural electrolysis tanks.

When the number of electrolysis tanks employed is increased, it becomes more difficult to achieve a sufficient roughness average Ra for the aluminum plate surface, however a sufficient value can be achieved by including sulfuric acid in the electrolyte solution. Accordingly, since a sufficient value for the roughness average Ra of the aluminum plate surface is achievable also when the present invention performs electrochemical surface roughening treatment with plural electrolysis tanks, productivity can be raised.

The number of electrolysis tanks is preferably between 3 and 10. Specifically, as long as there are 3 to 7 electrolysis tanks a sufficient value can be achieved for the roughness average Ra and productivity can also be raised.

Following completion of electrochemical surface roughening treatment, it is desirable to remove the solution from the aluminum plate with nip rollers, rinse the plate with water for 1 to 10 seconds, then remove the water with nip rollers.

Rinsing treatment is preferably performed using a spray line. The spray line used in rinsing treatment can, for example, have plural spray tips each discharging a fan shaped spray of water, with the spray line disposed along the width of the aluminum plate. The interval between the spray tips is preferably 20 to 100 mm, and the amount of water discharged per spray tip is preferably 1 to 20 L/min. Plural spray lines are preferably employed.

Measurement of the average opening size of indented portions generated by electrochemical surface roughening treatment can, for example, be performed by imaging the surface of the support from directly above with an electron microscope, at a magnification of 2000× or 50,000×. At least 50 individual generated pits formed with respective annular shaped pit peripheries are then obtained by extraction from the electron micrograph, and the average opening size derived as the opening size by reading out the diameter of the individual pits.

In order to suppress measurement variation, equivalent circular diameter measurements can be obtained using commercial image analysis software. When this method is adopted, the above electron micrographs are digitalized by importing with a scanner, then the equivalent circular diameter values derived after software binarization.

Measurements of the present inventors indicate that substantially the same values result from visual measurements and from digital processing.

Second Etching Treatment

The purpose of the second etching treatment is to dissolve smut that arises in the electrochemical surface roughening treatment and to dissolve the edges of the pits formed by the electrochemical surface roughening treatment. Since the edges of any large pits formed by the electrochemical surface roughening treatment are thus dissolved, the surface becomes smoother, and ink does not readily catch on such edges, planographic printing plate supports with excellent scumming resistance can be obtained.

The second etching treatment is basically the same as the first etching treatment, however the etching amount is preferably at least 0.01 g/m$^2$, more preferably at least 0.05 g/m$^2$ and even more preferably at least 0.1 g/m$^2$, but preferably not more than 10 g/m$^2$, more preferably not more than 5 g/m$^2$, and even more preferably not more than 3 g/m$^2$.

Second Desmutting Treatment t is preferable to perform acid pickling (second desmutting treatment) in order to remove contaminants (smut) remaining on the surface of the aluminum plate after the second etching treatment has been performed. The second desmutting treatment can be performed in the same way as the first desmutting treatment.

2. Second Exemplary Embodiment

Explanation now follows regarding an example of the present invention applied to a flat electrolytic surface roughening treatment device.

Figure 2:
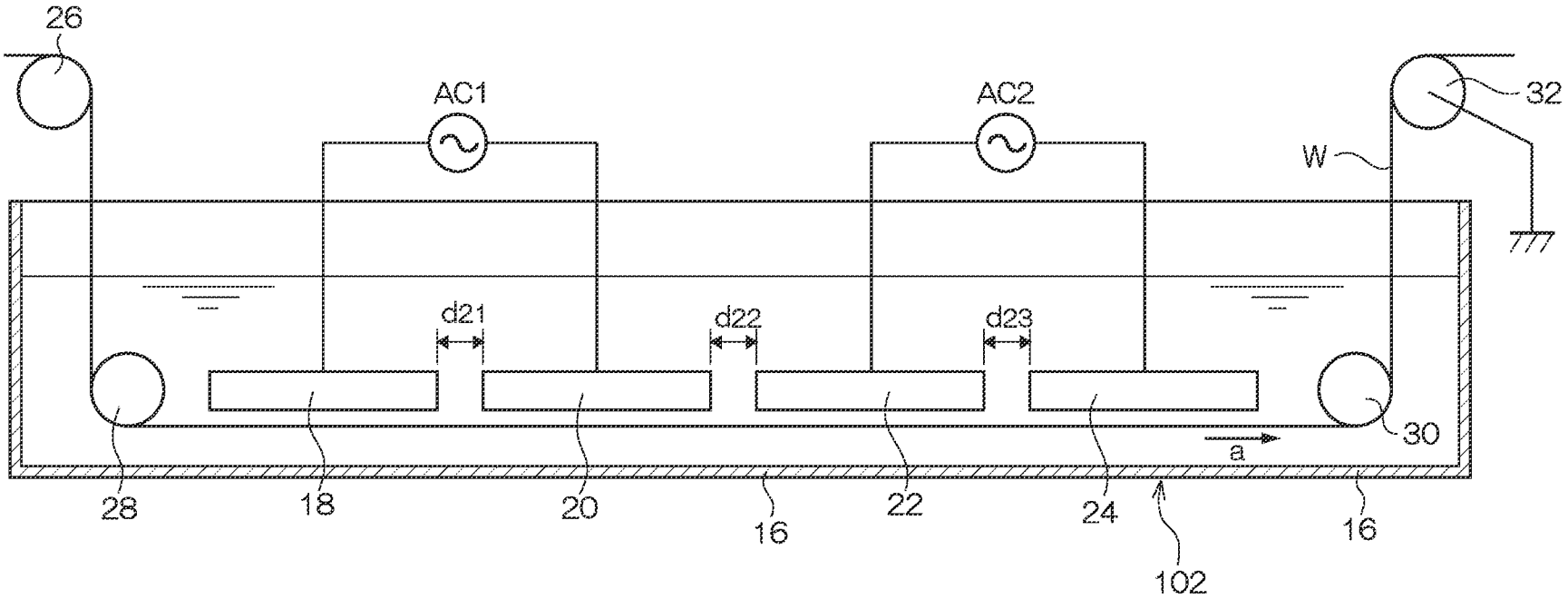
FIG. 2 is an outline cross-section showing a configuration of an electrolytic surface roughening treatment device according to a second exemplary embodiment.

An electrolytic surface roughening treatment device 102 of the second exemplary embodiment is a devise for electrolytic surface roughening treatment of an aluminum web W being conveyed in the arrow a direction, as shown in FIG. 2. The electrolytic surface roughening treatment device 102 includes: an electrolysis tank 16 of shallow box shape within which an acidic electrolyte solution is stored; guide rollers 28, 30 for guiding the aluminum web W along the bottom face of the electrolysis tank 16; electrodes 18, 20, 22, 24 provided in the electrolysis tank 16 above the conveying path of the aluminum web W and along the conveying path; a web introduction roller 26 disposed at the upstream of the guide roller 28 with respect to the conveying direction a of the aluminum web W; and a web dispatch roller 32 positioned at the downstream of the guide roller 30 with respect to the conveying direction a. Note that the web dispatch roller 32 provided is made of metal.

In the example shown in FIG. 2, the electrodes 18, 20 are connected to an AC power supply 1 and the electrodes 22, 24 are connected to an AC power supply 2, however all of the electrodes 18, 20, 22, 24 may be connected to the same power supply.

The length of the electrodes 18, 20, 22, 24 is d1, the separation distance between the electrodes 18, 20 is d21 (mm), the separation distance between the electrodes 20, 22 is d22 (mm), the separation distance between the electrodes 22, 24 is d23 (mm), the conveying velocity of the aluminum web W is denoted v (m/minute), the frequency of alternating current in the AC power supply 1 is denoted f1 (Hz), and the frequency of alternating current in the AC power supply 2 is denoted f2 (Hz). If the time when the web passes the near end of the electrode 18 is denoted t11 (0 seconds), then the time the web passes the far end of the electrode 18 is t12 (seconds), the time the web passes the near end of the electrode 20 is t21 (seconds), the time the web passes the far end of the electrode 20 is t22 (seconds), the time the web passes the near end of the electrode 22 is t31 (seconds), the time the web passes the far end of the electrode 22 is t32 (seconds), the time the web passes the near end of the electrode 24 is t41 (seconds) and the time the web passes the far end of the electrode 24 is t42 (seconds), then:

$$t12=t11+0.06d1/v=0.06d1/v$$

$$t21=t12+0.06d21/v=0.06(d1/v+d21/v)$$

$$t22=t21+0.06d1/v=0.06(d1/v+d21/v+d1/v)=0.06(2d1/v+d21/v)$$

$$t31=t22+0.06d22/v=0.06(2d1/v+d21/v+d22/v)$$

$$t32=t31+0.06d1/v=0.06(3d1/v+d21/v+d22/v)$$

$$t41=t32+0.06d23/v=0.06(3d1/v+d21/v+d22/v+d23/v)$$

$$t42=t41+0.06d1/v=0.06(4d1/v+d21/v+d22/v+d23/v)$$

The alternating current applied by the AC power supply 1 to the electrodes 18, 20 is of opposite phase to each other, and the alternating current applied by the AC power supply 2 to the electrodes 22, 24 is also of opposite phase to each other. Accordingly, the phase ϕ12 of the alternating current at the far end of the electrode 18, the phase ϕ21 of the alternating current at the near end of the electrode 20, the phase p22 of the alternating current at the far end of the electrode 20, the phase ϕ31 of the alternating current at the near end of the electrode 22, the phase ϕ32 of the alternating current at the far end of the electrode 22, the phase ϕ41 of the alternating current at the near end of the electrode 24, and the phase ϕ42 of the alternating current at the far end of the electrode 24 are, for example for a sine wave, respectively:

$$\phi 12=\sin(2\pi f1.t12)$$

$$\phi 21=-\sin(2\pi f1.t21)$$

$$\phi 22=-\sin(2\pi f1.t22)$$

$$\phi 31=\sin(2\pi f2.t31)$$

$$\phi 32=\sin(2\pi f2.t32)$$

$$\phi 41=-\sin(2\pi f2.t41)$$

$$\phi 42=-\sin(2\pi f2.t42).$$

In the present application "waveforms do not reinforce" means that the phase difference ϕ12−ϕ21 between the phase ϕ12 of the alternating current at the far end of the electrode 18 and the phase ϕ21 of the alternating current at the near end of the electrode 20, the phase difference ϕ22−ϕ31 between the phase ϕ22 of the alternating current at the far end of the electrode 20 and the phase ϕ31 of the alternating current at the near end of the electrode 22, the phase difference ϕ32−ϕ41 between the phase ϕ32 of the alternating current at the far end of the electrode 22 and the phase ϕ41 of the alternating current at the near end of the electrode 24 take absolute values and are not zero.

Note that (for cases in which the alternating current from the AC power supply 1 and the AC power supply 2 are both sign waves) the phase difference ϕ12−ϕ21

$$=\sin(2\pi f1.t12)+\sin(2\pi f1.t21)$$

$$=\sin(2\pi f1.0.06d1/v)+\sin[2\pi f1.0.06(d1/v+d21/v)],$$

the phase difference ϕ22−ϕ31

$$=-\sin(2\pi f2.t31)-\sin(2\pi f1.t22)$$

$$=-\sin\{2\pi f2.(t22+0.06d22/v)\}-\sin(2\pi f1.t22),\text{ and}$$

the phase difference ϕ32−ϕ41

$$=\sin(2\pi f2.t32)+\sin[2\pi f2.(t32+0.06d23/v)].$$

Similarly to in the first exemplary embodiment, the separation distance d21, d22 and d23 are set to give a large absolute value for the phase difference between the alternating current and voltage waveform at the far ends of the electrodes 18, 20, 22 and the respective near ends of the electrodes 20, 22, 24, specifically a value of 0.2 or greater, and preferably 0.7 or greater. The alternating current and voltage waveforms applied to the aluminum web W at the far end of the electrode 18 and the near end of the electrode 20, and at the far end of the electrode 22 and the near end of the electrode 24, are thereby prevented from reinforcing each other.

Note that in order to ensure that the alternating current and voltage waveforms applied to the aluminum web W at the far end of the electrode 20 and the near end of the electrode 22 do not reinforce each other, the frequency 1 of the AC power supply 1, the frequency 2 of the AC power supply 2 and the conveying velocity V may be set such that the phase differences of the alternating current and voltage waveforms at the far ends of the electrodes 18, 20, 22 and the respective near ends of the electrodes 20, 22, 24 satisfy the above relationship.

Explanation now follows regarding operation of the electrolytic surface roughening treatment device 102.

The aluminum web W being conveyed in from the left hand side in FIG. 2 is first introduced by the web introduction roller 26 into the electrolysis tank 16, then guided towards the downstream side electrodes 18, 20, 22, 24 by guide rollers 28, 30, and then led out of the electrolysis tank 16 by the web dispatch roller 32.

The aluminum web W introduced into the electrolysis tank 16 is conveyed along the electrodes 18, 20, 22, 24, and an anodic or cathodic reaction occurs at the side facing towards the electrodes 18, 20 due to the alternating waveform current applied to the electrodes 18, 20 from the AC power supply 1.

The aluminum web W that has passed to the downstream side of the electrodes 18, 20 is then conveyed along the electrodes 22, 24, and an anodic or cathodic reaction occurs at the side facing towards the electrodes 22, 24 due to the alternating waveform current applied to the electrodes 22, 24 by the AC power supply 2, forming honeycomb pits over the entire surface.

As stated in the first exemplary embodiment, since the separation distances d21, d22, d23, the frequencies 1, 2, and/or the conveying velocity V are set such that there is a large absolute value for the phase difference of the alternating current and voltage waveforms at the far ends of the electrodes 18, 20, 22 and the respective near ends of the electrodes 20, 22, 24, the alternating current and voltage waveforms applied to the aluminum web W at the far ends of the electrodes 18, 20, 22 and the alternating current and voltage waveforms applied to the aluminum web W at the respective near ends of the electrodes 20, 22, 24 do not reinforce each other. Consequently, for example, even were chatter marks to occur at a given location on the aluminum web W when at the far end of the electrodes 18, 20, 22, since an electrochemical reaction tending to cancel out these chatter marks occurs to the given location on the aluminum web W when at the respective near end of the electrodes 20, 22, 24, the chatter marks are not emphasized and so defined chatter marks do not occur.

3. Third Exemplary Embodiment

Explanation follows regarding the present invention in a different application to a flat electrolytic surface roughening treatment device.

Figure 3:
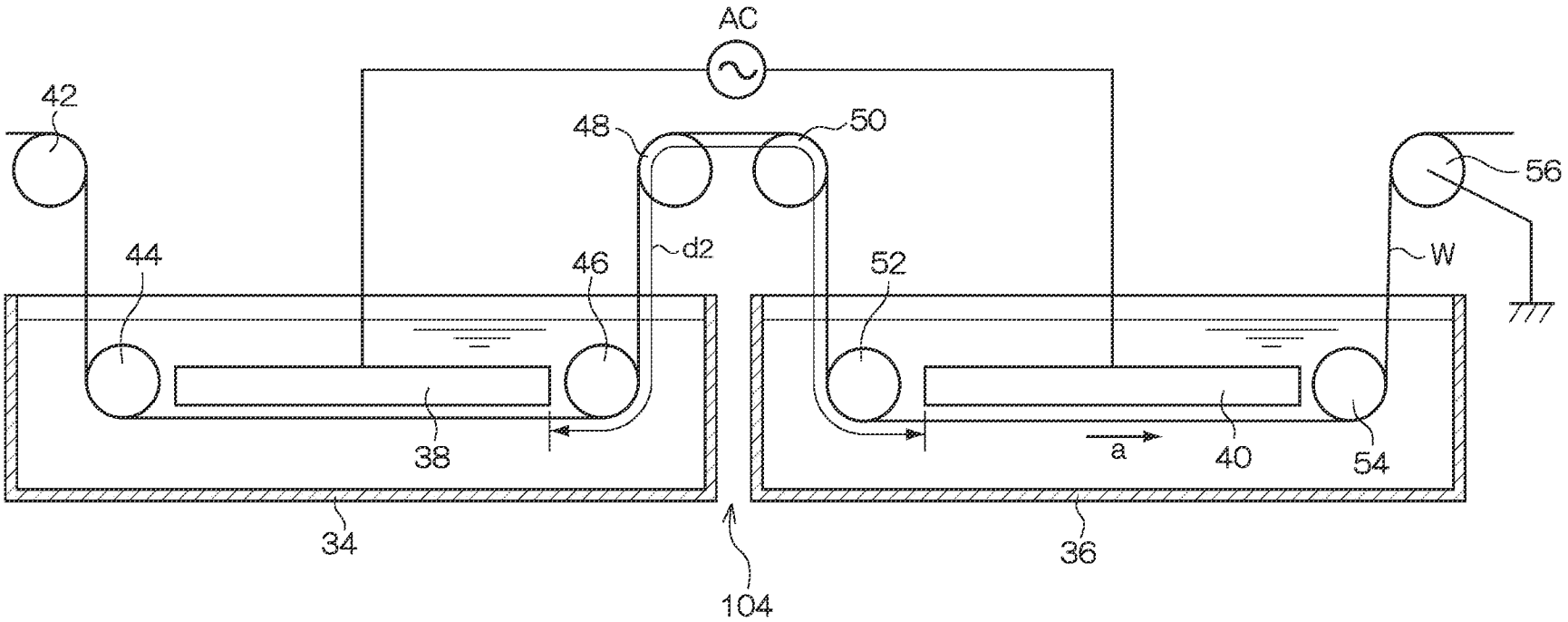
FIG. 3 is an outline cross-section showing a configuration of an electrolytic surface roughening treatment device according to a third exemplary embodiment.

An electrolytic surface roughening treatment device 104 according to a third exemplary embodiment is a device for performing electrolytic surface roughening of an aluminum web W conveyed in the arrow a direction, as shown in FIG. 3. The electrolytic surface roughening treatment device 104 includes: a shallow box shaped electrolysis tank 34; a box shaped electrolysis tank 36, of the same shallowness as the electrolysis tank 34 and positioned downstream thereof in the conveying direction a; guide rollers 44, 46 for guiding an aluminum web W along the bottom face of the electrolysis tank 34; guide rollers 52, 54 for guiding the aluminum web W along the bottom face of the electrolysis tank 36; an upstream electrode 38 provided in the electrolysis tank 34 above the conveying path of the aluminum web W and along the conveying path; and a downstream electrode 40 provided in the electrolysis tank 36 above the conveying path of the aluminum web W and along the conveying path. The upstream electrode 38 and the downstream electrode 40 correspond respectively to the first electrode and other electrode of the present invention. The guide rollers 46, 52, a web dispatch roller 48 and a web introduction roller 50 around which the aluminum web W is entrained between the upstream electrode 38 and the downstream electrode 40 and correspond to the web conveying rollers of the present invention.

An acidic electrolyte solution is stored in both the electrolysis tank 34 and the electrolysis tank 36.

The upstream electrode 38 and the downstream electrode 40 are connected to an AC power supply.

Outside the electrolysis tank 34 there is a web introduction roller 42 provided at the upstream side of a guide roller 44 with respect to the conveying direction a of the aluminum web W, and the web dispatch roller 48 is provided at the downstream side of the guide roller 46 with respect to the conveying direction a. Outside the electrolysis tank 36 the web introduction roller 50 for introducing the aluminum web W into the electrolysis tank 36 is provided adjacent to the web dispatch roller 48. A web dispatch roller 56 is also provided outside the electrolysis tank 36, at the downstream side of the guide roller 54. The web dispatch roller 56 is made of metal and earthed.

In the section between the electrolysis tank 34 and the electrolysis tank 36, the aluminum web W is guided to outside of the electrolysis tank 34 and the electrolysis tank 36 by the web dispatch roller 48 and the web introduction roller 50. The length of the upstream electrode 38 along the web conveying path is denoted d1 (mm), the conveying separation distance from the far end of the upstream electrode 38 to the near end of the downstream electrode 40 is denoted d2 (mm), the frequency of alternating current output from the AC power supply is denoted f (Hz), the conveying velocity of the aluminum web W is denoted v (m/minute). If the time when web passes the near end of the upstream electrode 38 is 0, then the time when the web passes the far end of the upstream electrode 38 is denoted t1 (seconds), and the time when the web passes the near end of the downstream electrode 40 is denoted t2 (seconds). Accordingly, similarly to in the first exemplary embodiment:

$$t1=0.06d1/v, \text{ and}$$

$$t2=0.06(d1+d2)/v.$$

Since the phases of alternating current applied to the upstream electrode 38 and the downstream electrode 40 are opposite to each other, if the phase of the alternating current at the far end of the upstream electrode 38 is denoted $\phi$1 and the phase of the alternating current at the near end of the downstream electrode 40 is denoted $\phi$2, then for a sine wave, $$\phi1=\sin(2\pi f.t1), \text{ and}$$

$$\phi2=-\sin(2\pi f.t2)$$

respectively. Consequently, the separation distance d2 is set such that the absolute value of the phase difference $\phi$1−$\phi$2 is large, specifically 0.2 or greater, and preferably 0.7 or greater.

Methods for setting the separation distance d2 include adjusting the electrode length and/or disposed position of the upstream electrode 38 and the downstream electrode 40, adjusting the roller height and/or external diameter of the guide rollers 46, 52, and adjusting the roller height and/or external diameter of the web dispatch roller 48 and the web introduction roller 50. The most preferred method from among these is the method of adjusting the position and external diameter of the web dispatch roller 48 and the web introduction roller 50. Note that the roller height is a height at the center of the guide roller 46, which could also be referred to as a setting position.

Accordingly, since alternating currents of different phase are applied to the aluminum web W at the far end of the upstream electrode 38 and the near end of the downstream electrode 40, the alternating current and voltage waveform at the far end of the upstream electrode 38 and the near end of the downstream electrode 40 do not reinforce each other.

Explanation has been given above of examples in which the present invention is applied to electrolytic surface roughening treatment devices equipped with both radial and flat electrolysis tanks, however the present invention is also applicable to an electrolytic surface roughening treatment device equipped with a vertical electrolysis tank.

EXAMPLES

1. Examples 1 to 3 and Comparative Examples 1 to 3

Explanation follows regarding examples of electrolytic surface roughening treatment of an aluminum web W using the electrolytic surface roughening treatment devices of the first or the third exemplary embodiments. Examples 1 and 3 and Comparative Examples 1 to 3 are each examples employing the electrolytic surface roughening treatment device according to the first exemplary embodiment. Example 2 is an example employing the electrolytic surface roughening treatment device according to the third exemplary embodiment. The roller height is set such that there is a separation distance of 200 mm from the center of the guide roller 46 to the center of the web dispatch roller 48, and a separation distance of 200 mm from the center of the guide roller 52 to the center of the web introduction roller 50.

(1) Aluminum Plate Fabrication

A melt is prepared using an aluminum alloy containing each of the components (wt %) shown in Table 1, with the remaining portion being Al and inevitable impurities. After performing melting and filtering, an ingot of 500 mm thickness and 1200 mm width is produced with a DC casting method. Soaking is performed for about 5 hours at 550° C. after scalping the surface to an average of 10 mm using a facing machine, and then, after the temperature has dropped to 400° C., the ingot is rolled with a hot-rolling mill to plate of 2.7 mm thickness. After heat treatment with a continuous annealing machine at 500° C., cold-rolling is then performed to obtain an aluminum plate 1 finished to a thickness of 0.3 mm and width of 1060 mm.

TABLE 1

| Aluminum Plate | Si | Fe | Cu | Mn | Mg | Cr | Zn | Ti |
|---|---|---|---|---|---|---|---|---|
| 1 | 0.080 | 0.300 | 0.001 | 0.001 | 0.000 | 0.001 | 0.003 | 0.021 |

(2) Planographic Printing Plate Support Fabrication

Surface Treatment

Surface treatment is by successively subjecting to each of the treatments (a) to (g) as set out below.

(a) Etching in Aqueous Alkali Solution (First Etching)

Etching is performed by spraying each aluminum plate from a spray line with an aqueous solution having a sodium hydroxide concentration of 370 g/L, an aluminum ion concentration of 1 g/L and a temperature of 60° C. The amount etched from the surface of each aluminum plate to be subsequently subjected to electrochemical surface roughening treatment is 3 g/m$^2$. The solution is then removed from each plate with nip rollers. Rinsing treatment is then performed for 5 seconds using fan shaped sprays of water directed from spray tips mounted on spray lines, and the rinse water is then also removed with nip rollers.

(b) Desmutting in Aqueous Acidic Solution

Desmutting is performed by spraying each aluminum plate with an aqueous solution having a sulfuric acid concentration of 170 g/L, an aluminum ion concentration of 5 g/L and a temperature of 50° C. for 5 seconds from a spray line. Wastewater from the subsequently described anodizing treatment step (i) is used here as the aqueous sulfuric acid solution. The solution is then removed from each plate with nip rollers. Rinsing treatment is then performed for 5 seconds using fan shaped sprays of water directed from spray tips mounted on spray lines, and the rinse water is then also removed from the plate with nip rollers.

(c) Electrochemical Surface Roughening Treatment Using Alternating Current in Aqueous Acidic Solution Electrochemical surface roughening treatment is performed with an electrolyte solution with 15 g/L of hydrochloric acid.

The total amount of electricity used while the aluminum plate is acting as an anode is 450 C/dm$^2$, with a current density of 25 A/dm$^2$.

Concentration control of the electrolyte solution is performed according to a predetermined data table by adding hydrochloric acid in an amount corresponding to the amount of applied electricity and replenishment water that including a desired concentration of nitric acid added thereto in advance. Control is performed by establishing in advance how the relationship between the electrical conductivity and the ultrasonic wave propagation velocity of the electrolyte solution corresponds to the composition of the electrolyte solution and preparing a data table. The amounts of hydrochloric acid and replenishment water to be added are then adjusted by feedback control based on measurement results on the electrical conductivity and the ultrasonic wave propagation velocity in the electrolyte solution.

The solution is then removed with nip rollers. Rinsing treatment is then performed for 5 seconds using fan shaped sprays of water directed from spray tips mounted on spray lines, and the rinse water is also then removed with nip rollers.

(d) Etching in Aqueous Alkali Solution (Second Etching)

Etching is performed by spraying the aluminum plate from a spray line with an aqueous solution having a sodium hydroxide concentration of 370 g/L, an aluminum ion concentration of 1 g/L and a temperature of 35° C. The amount of material etched from the surface of each aluminum plate subjected to electrochemical surface roughening treatment is 0.2 g/m$^2$. The solution is then removed with nip rollers. Rinsing treatment is then performed for 5 seconds using fan shaped sprays of water directed from spray tips mounted on spray lines, and the rinse water is then also removed with nip rollers.

(3) Surface Examination of Planographic Printing Plate Supports

The surface of the planographic printing plate supports is examined by eye for chatter marks. Where no chatter marks are observed this is evaluated as "G", and when observed as "NG". With respect to uniformity of graining, the surface of the planographic printing plate supports is examined under a scanning electron microscope JSM-5500 (manufactured by JEOL, Ltd.) at a magnification of 1500×, and where non-uniformity is not observed this is evaluated as "G" and when observed "NG".

Conditions and results are shown in Table 3 and Table 2.

TABLE 2

| | Conveying Velocity (m/minute) | Separation Distance d1 (mm) | Upstream Electrode Far End to Downstream Electrode Near end Separation Distance d2 (mm) | Waveform Reinforcement | Chatter Marks | Uniformity of Graining |
|---|---|---|---|---|---|---|
| Example 1 | 45 | 350 | 120 | Yes | G | G |
| Example 2 | 60 | 400 | 650 | Yes | G | G |
| Example 3 | 80 | 400 | 170 | Yes | G | G |
| Comparative Example 1 | 75 | 350 | 220 | No | NG | NG |
| Comparative Example 2 | 60 | 400 | 170 | No | NG | NG |
| Comparative Example 3 | 60 | 350 | 220 | No | NG | NG |

TABLE 3

| | Separation Distance d1 (mm) | Conveying Velocity (m/minute) | Power supply Frequency f (Hz) | Upstream Electrode Far End Passing Time t1 = 0.06 d1/v | Phase □1 at Upstream Electrode Far End sin (2πft1) | Upstream Electrode Far End to Downstream Electrode Near end Separation Distance d2 (mm) |
|---|---|---|---|---|---|---|
| Example 1 | 350 | 45 | 50 | 0.47 | 0.90 | 120 |
| Example 2 | 400 | 60 | 50 | 0.40 | −0.06 | 650 |
| Example 3 | 400 | 80 | 60 | 0.30 | −0.06 | 170 |
| Comparative Example 1 | 350 | 75 | 60 | 0.28 | −0.97 | 220 |
| Comparative Example 2 | 400 | 60 | 50 | 0.40 | −0.06 | 170 |
| Comparative Example 3 | 350 | 60 | 50 | 0.35 | 0.06 | 220 |

| | Downstream Electrode Near End Passing Time t2 = 0.06 (d1 + d2)/v | Phase □2 at Downstream Electrode Near End sin (2πft2) | □1 − □2 | \|□1 − □2\| |
|---|---|---|---|---|
| Example 1 | 0.76 | 0.12 | 0.78 | 0.78 |
| Example 2 | 1.01 | −0.99 | 0.92 | 0.92 |
| Example 3 | 0.43 | 0.76 | −0.82 | 0.82 |
| Comparative Example 1 | 0.46 | −0.82 | −0.14 | 0.14 |
| Comparative Example 2 | 0.57 | −0.09 | 0.03 | 0.03 |
| Comparative Example 3 | 0.57 | −0.09 | 0.15 | 0.15 |

As can be seen from Table 2, in Examples 1 to 3, since the absolute value of the phase difference ϕ1−ϕ2 between the far end of the upstream electrode and the near end of the downstream electrode is large, from 0.78 to 0.92, the alternating current and voltage waveforms do not reinforce each other. Accordingly, neither chatter marks nor non-uniformity in graining is observed to occur. In contrast thereto, in the Comparative Examples 1 to 3, the absolute value of the phase difference ϕ1−ϕ2 between the far end of the upstream electrode and the near end of the downstream electrode is small, from 0.03 to 0.15, and the alternating current and voltage waveforms at the far end of the upstream electrode and the near end of the downstream electrode reinforce each other. Accordingly, both chatter marks and non-uniformity in graining are observed.

The invention claimed is:

1. An electrolytic treatment method of electrolytic treatment by conveying a web at a specific conveying velocity along a specific direction and applying an alternating current to a plurality of electrodes disposed along the conveying direction of the web, the electrolytic treatment method comprising setting the web conveying velocity, frequencies of alternating current applied to a first electrode and another electrode, and web conveying direction separation distance between the first electrode and the other electrode, such that the alternating current and voltage waveform applied to the web when a point in the length direction on the web passes the far end of the first electrode and the alternating current and voltage waveform applied to the web when the point passes the near end of the other electrode adjacent on the downstream side of the first electrode do not reinforce each other, wherein $$|\phi 1-\phi 2|\geq 0.7,$$

where ϕ1 is the phase of the alternating current at the far end of the first electrode and ϕ2 is the phase of the alternating current at the near end of the other electrode.

2. The electrolytic treatment method of claim 1, wherein the web is a web of either pure aluminum or an aluminum alloy.

3. The electrolytic treatment method of claim 1, wherein the web conveying direction separation distance between the first electrode and the other electrode is set by providing a web conveying roller entrained by the web between the first electrode and the other electrode, and setting the height and/or the external diameter of the web conveying roller.

4. The electrolytic treatment method of claim 2, wherein the web conveying direction separation distance between the first electrode and the other electrode is set by providing a web conveying roller entrained by the web between the first electrode and the other electrode, and setting the height and/or the external diameter of the web conveying roller.

5. An electrolytic treatment device for performing electrolytic treatment by conveying a web at a specific conveying velocity along a specific direction and applying an alternating current to a plurality of electrodes disposed along the conveying direction of the web, wherein in the electrolytic treatment device, the web conveying velocity, frequencies of alternating current applied to a first electrode and another electrode, and web conveying direction separation distance between the first electrode and the other electrode, are set such that the alternating current and voltage waveform applied to the web when a point in the length direction on the web passes the far end of the first electrode and the alternating current and voltage waveform applied to the web when the point passes the near end of the other electrode adjacent on the downstream side of the first electrode do not reinforce each other, wherein $$|\phi 1-\phi 2|\geq 0.7,$$

where $\phi 1$ is the phase of the alternating current at the far end of the first electrode and $\phi 2$ is the phase of the alternating current at the near end of the other electrode.

6. The electrolytic treatment device of claim 5, wherein the web is a web of either pure aluminum or an aluminum alloy.

7. The electrolytic treatment device of claim 5, wherein the web conveying direction separation distance between the first electrode and the other electrode is set by providing a web conveying roller entrained by the web between the first electrode and the other electrode, and setting the height and/or the external diameter of the web conveying roller.

8. The electrolytic treatment device of claim 6, wherein the web conveying direction separation distance between the first electrode and the other electrode is set by providing a web conveying roller entrained by the web between the first electrode and the other electrode, and setting the height and/or the external diameter of the web conveying roller.

* * * * *